US006702134B2

(12) United States Patent
Scalese et al.

(10) Patent No.: US 6,702,134 B2
(45) Date of Patent: Mar. 9, 2004

(54) CLOSURE SYSTEM

(75) Inventors: Robert F. Scalese, Escondido, CA (US); Daniel L. Kacian, San Diego, CA (US)

(73) Assignee: Gen-Probe Incorporated, San Diego, CA (US)

( * ) Notice: Subject to any disclaimer, the term of this patent is extended or adjusted under 35 U.S.C. 154(b) by 0 days.

(21) Appl. No.: 10/259,071

(22) Filed: Sep. 27, 2002

(65) Prior Publication Data

US 2003/0062330 A1 Apr. 3, 2003

Related U.S. Application Data

(60) Provisional application No. 60/325,512, filed on Sep. 28, 2001.

(51) Int. Cl.[7] ..... B65D 41/00

(52) U.S. Cl. ..... 215/344; 215/354; 215/341; 215/329; 215/44; 215/45

(58) Field of Search ..... 215/341, 343, 215/344, 354, 329, 44, 45

(56) References Cited

U.S. PATENT DOCUMENTS

| | | | | |
|---|---|---|---|---|
| 3,441,161 | A | | 4/1969 | Van Baarn |
| D216,491 | S | | 1/1970 | Brown |
| 3,494,496 | A | | 2/1970 | Livingstone |
| 3,696,957 | A | | 10/1972 | Van Baarn |
| 3,741,424 | A | | 6/1973 | Landen |
| 4,053,077 | A | | 10/1977 | DeFelice |
| 4,177,906 | A | | 12/1979 | Von Hagel |
| 4,206,852 | A | | 6/1980 | Dunn et al. |
| 4,257,526 | A | | 3/1981 | Weits et al. |
| 4,298,129 | A | | 11/1981 | Stull |
| 4,301,937 | A | | 11/1981 | Von Hagel |
| 4,322,011 | A | | 3/1982 | Mumford |
| 4,489,845 | A | | 12/1984 | Aichinger et al. |
| 4,546,085 | A | | 10/1985 | Johansson et al. |
| 4,640,428 | A | | 2/1987 | Chang |
| 4,712,699 | A | | 12/1987 | Lutz |
| 4,858,776 | A | | 8/1989 | Mehra |
| 5,020,683 | A | | 6/1991 | Strassheimer |
| 5,100,013 | A | | 3/1992 | Strassheimer |
| 5,169,603 | A | | 12/1992 | Landsberger |
| 5,456,375 | A | | 10/1995 | May |
| 5,579,928 | A | | 12/1996 | Anukwuem |
| 5,630,522 | A | | 5/1997 | Montgomery |
| 5,720,402 | A | | 2/1998 | May |
| 5,738,231 | A | * | 4/1998 | Montgomery ..... 215/44 |
| 5,916,525 | A | | 6/1999 | Husar et al. |
| 5,916,527 | A | | 6/1999 | Haswell |
| 5,927,527 | A | | 7/1999 | Montgomery et al. |
| 5,954,215 | A | | 9/1999 | Alter |
| 6,041,953 | A | | 3/2000 | Goodall |
| 6,044,994 | A | * | 4/2000 | Miller ..... 215/344 |
| 6,044,995 | A | | 4/2000 | Dai |
| 6,439,411 | B1 | | 8/2002 | Schwarz |
| 6,488,165 | B1 | | 12/2002 | Hidding |
| 6,491,175 | B1 | | 12/2002 | Taha |
| 6,533,136 | B1 | | 3/2003 | Willingham |

FOREIGN PATENT DOCUMENTS

| | | |
|---|---|---|
| DE | 19521924 A1 | 1/1996 |
| JP | 55-64059 A | 5/1980 |
| WO | WO01/55000 A1 | 8/2001 |

* cited by examiner

*Primary Examiner*—Jacob K. Ackun
(74) *Attorney, Agent, or Firm*—Charles B. Cappellari

(57) ABSTRACT

A closure system useful for storing fluids under cold storage conditions. The closure system includes cap and container components which combine to form a dual sealing system. The container has a generally cylindrical side wall, a closed bottom end, and an open top end having an inner beveled lip depending from an annular top rim. The cap has a generally circular top wall from which inner and outer skirts depend. The outer skirt is adapted to grip the open top end of the container. The inner skirt includes an outer surface having a lower seal bead and an upper beveled portion mated with the beveled lip. When the cap is fitted onto the container, the seal bead contacts an inner surface of the container and the upper beveled portion and the beveled lip are engaged in an interference fit, thereby impeding the loss of fluid from the closure system under cold storage conditions.

17 Claims, 10 Drawing Sheets

CLOSURE SYSTEM

This application claims the benefit of U.S. Provisional Application No. 60/325,512, filed Sep. 28, 2001, the contents of which are hereby incorporated by reference herein.

FIELD OF THE INVENTION

The present invention relates to a substantially leak-proof closure system for storing fluids under cold storage conditions, where the closure system includes a container component and a cap component which can be fitted onto the container component.

INCORPORATION BY REFERENCE

All references referred to herein are hereby incorporated by reference in their entirety. The incorporation of these references, standing alone, should not be construed as an assertion or admission by the inventors that any portion of the contents of all of these references, or any particular reference, is considered to be essential material for satisfying any national or regional statutory disclosure requirement for patent applications. Notwithstanding, the inventors reserve the right to rely upon any of such references, where appropriate, for providing material deemed essential to the claimed invention by an examining authority or court. No reference referred to herein is admitted to be prior art to the claimed invention.

BACKGROUND OF THE INVENTION

Procedures for determining the presence or absence of specific organisms or viruses in a test sample commonly rely upon nucleic acid-based probe testing. To increase the sensitivity of these tests, an amplification step is often included to increase the number of potential nucleic acid target sequences present in the test sample. During amplification, polynucleotide chains containing the target sequence or its complement are synthesized in a template-dependent manner from ribonucleoside or deoxynucleoside triphosphates using nucleotidyltransferases known as polymerases. There are many amplification procedures in common use today, including the polymerase chain reaction (PCR), Q-beta replicase, self-sustained sequence replication (3SR), transcription-mediated amplification (TMA), nucleic acid sequence-based amplification (NASBA), ligase chain reaction (LCR), strand displacement amplification (SDA) and loop-mediated isothermal amplification (LAMP), each of which is well known in the art. See, e.g., Mullis, "Process for Amplifying Nucleic Acid Sequences," U.S. Pat. No. 4,683,202; Erlich et al., "Kits for Amplifying and Detecting Nucleic Acid Sequences," U.S. Pat. No. 6,197,563; Walker et al., *Nucleic Acids Res.,* 20:1691–1696 (1992); Fahy et al., "Self-sustained Sequence Replication (3WSR): An Isothermal Transcription-Based Amplification System Alternative to PCR," *PCR Methods and Applications,* 1:25–33 (1991); Kacian et al., "Nucleic Acid Sequence Amplification Methods," U.S. Pat. No. 5,399,491; Davey et al., "Nucleic Acid Amplification Process," U.S. Pat. No. 5,554,517; Birkenmeyer et al., "Amplification of Target Nucleic Acids Using Gap Filling Ligase Chain Reaction," U.S. Pat. No. 5,427,930; Marshall et al., "Amplification of RNA Sequences Using the Ligase Chain Reaction," U.S. Pat. No. 5,686,272; Walker, "Strand Displacement Amplification," U.S. Pat. No. 5,712,124; Notomi et al., "Process for Synthesizing Nucleic Acid," U.S. Pat. No. 6,410,278; Dattagupta et al., "Isothermal Strand Displacement Amplification," U.S. Pat. No. 6,214,587; and HELEN H. LEE ET AL., NUCLEIC ACID AMPLIFICATION TECHNOLOGIES: APPLICATION TO DISEASE DIAGNOSIS (1997).

Because polymerase activity is readily lost at ambient temperature, it is common to manufacture amplification kits which include polymerase-containing enzyme reagents that have been freeze-dried in formulations containing other necessary co-factors and substrates for amplification. See, e.g., Shen et al., "Stabilized Enzyme Compositions for Nucleic Acid Amplification," U.S. Pat. No. 5,834,254. It is also common to manufacture amplification kits which include amplification reagents containing nucleoside triphosphates and/or amplification primers in freeze-dried formulations. Alternatively, these enzyme and amplification reagents can be kept in cold storage at temperatures well below 0° C. (e.g., at about −20° C.). An advantage of cold storage is that reagents can be manufactured and shipped directly on dry ice to the end user, avoiding lengthy and expensive lyophilization procedures prior to shipping, as well as time-consuming and exact reconstitution procedures by the end-user. However, storing fluid reagents in laboratory freezers is generally disfavored because these reagents, which may contain, for example, glycerol or non-ionic detergents (non-ionic detergents can be used to sequester ionic detergents in a sample solution which may solubilize target nucleic acid or interfere with enzyme function and are often used to stabilize the enzymes), tend to remain highly viscous fluids in commonly used sub-zero freezers.

As the volume of these highly viscous fluids expands under cold storage conditions, one leak theory provides that a significant meniscus forms and rises which, if high enough, can seep through the seals of conventional storage containers. Other leak theories relate to temperature fluctuations due to the repeated opening and closing of storage freezers. According to one of these theories, it is believed that the stored fluid freezes and water is removed from the frozen fluid by sublimation which settles, inter alia, in the interstices between the cap and the container. When the storage freezer is subsequently opened, the temperature within the freezer rises and the water vapor forms a condensate which freezes as the storage freezer is restored to its normal operating temperature. As the condensate freezes, it expands in the interstices between the cap and the container, thereby weakening the seal. Another of these theories provides that the stored fluid does not freeze, but the opening and closing of the storage freezer causes temperature fluctuations which lead to the formation of a condensate in the interstices between the cap and the container. Like the sublimation theory, the freezing of this condensate as the storage freezer is restored to its normal operating temperature could result in sufficient expansion between the cap and the container to create fissures which might provide an avenue of escape for fluid stored in the container.

Besides wasting expensive reagents, seepage of reagents from their storage containers is especially problematic when the reagents have been aliquoted for use in a specified number of amplification reactions in an automated instrument. (See Ammann et al., "Automated Process for Isolating and Amplifying a Target Nucleic Acid Sequence," U.S. Pat. No. 6,335,166, for an example of an instrument for performing automated nucleic acid amplification and detection steps.) Therefore, loss of some reagent from the container could affect amplification efficiency in one or more assays.

Consequently, it would desirable to have a closure system that provides a sealing system which prevents or severely limits seepage of a stored fluid substance under cold storage conditions, especially substances which remain at least partially fluid under those cold storage conditions. Such substances may include one or more components affecting the viscosity or surface tension of the stored fluid or which contribute to freezing point depression of the stored fluid. In particular, the desired closure system would be useful for storing enzyme and/or amplification reagents for use in a nucleic acid amplification reaction, where the reagents are stored in a conventional laboratory freezer at a temperature of about −20° C. To accommodate its use in an automated instrument, the closure system should preferably be designed so that its internal volume is maximized and so that a robotic pipettor will have access to all or nearly all of the full volume of the stored fluid reagent.

SUMMARY OF THE INVENTION

The present invention meets this need by providing a substantially leak-proof closure system for storing fluids under cold temperature conditions which includes a container and a cap. The container component, which is generally cylindrical in shape, includes a side wall having inner and outer surfaces, a closed bottom end and an open top end having an annular top rim and a beveled lip which depends inward from the inner circumference of the top rim. The cap component includes a top wall having a generally circular shape, an annular outer skirt which depends from the periphery of the top wall and has an inner surface adapted to grip the outer surface of the top end of the container (e.g., mated helical threads or snap-fit arrangement), and an annular inner skirt which depends from the top wall and has an outer surface which comprises a lower seal bead and an upper beveled portion which is mated with the beveled lip of the container. The seal bead of the inner skirt is sized and arranged to be in sealing contact with the inner surface of the top end of the container when the cap is fitted onto the container. By "sealing contact" is meant an interference force fit between the seal bead of the cap and the inner surface of the container. Additionally, the upper beveled portion of the cap and the beveled lip of the container are engaged in an interference fit when the cap is fitted onto the container. The interference fit of this closure system is expected to provide a substantially leak-proof sealing system under cold storage conditions. As used herein, "cold storage conditions" refers to conditions under which water freezes.

In one embodiment of the present invention, the outer surface of the inner skirt is configured so that an annular air pocket is formed between the outer surface of the inner skirt and the inner surface of the container and between the seal bead and the upper beveled portion when the cap is fitted onto the container. This configuration permits greater deflection of the seal bead as the inner skirt is inserted into the container, thereby increasing the load of the seal bead on the inner surface of the container and, thus, reducing the opportunity for fluid leakage. Preferably, the outer surface of the inner skirt has a generally arcuate shape between the beveled portion and the seal bead, and an inner surface of the inner skirt has a generally cylindrical shape.

In another embodiment of the present invention, a bottom surface of the inner skirt is rounded or beveled so that a rising meniscus in the closure system may be at least partially diverted into an area defined by the inner surface of the inner skirt under cold storage conditions. In this way, the forces exerted by an expanding fluid may be substantially equilibrated on both sides of the bottom surface of the inner skirt or, preferably, those forces exerted by the expanding fluid on the inner surface of the inner skirt will exceed those forces exerted on the outer surface of the inner skirt.

In yet another embodiment of the present invention, the inner surface of the container adjacent to and below the beveled lip includes a substantially no draft region (i.e., a region which is not tapered relative to the longitudinal axis of the container), and the seal bead sealingly contacts the inner surface in the no draft region when the cap is fitted onto the container. To further improve the seal between the seal bead and the no draft region, the core pin used to form the container during an injection molding procedure is preferably given a radial polish and, in the no draft region, hand-lapped prior to injection molding to prevent the formation of draw and sink lines on the inner surface of the molded container, especially in the no draft region. In this embodiment, the outer diameter of the seal bead is preferably smaller than the inner diameter of the top rim and greater than the inner diameter of the no draft region to facilitate the formation of a seal between inner surface of the top end of the container and the outer surface of the inner skirt of the cap.

In still another embodiment of the present invention, the closure system is provided with a solution having added thereto at least one component which contributes to freezing point depression of the solution (e.g., a salt), increases the viscosity of the solution (e.g., ethylene glycol, glycerol or dextran), or alters the surface tension of the solution (e.g., a detergent, surfactant or oil). Such solutions may further include one or more enzyme reagents (e.g., RNA or DNA polymerase) for use in amplifying a nucleic acid sequence of interest. Enzyme reagents for use in performing a transcription-based amplification, for example, include reverse transcriptase and RNA polymerase. Other amplification reagents may also be included, such as, for example, amplification oligonucleotides (e.g., primers, promoter-primers and/or splice templates), nucleotide triphosphates, metal ions and co-factors necessary for enzymatic activity. The reagents are preferably provided in buffered formulations such as, for example, formulations comprising 0.01% (v/v) TRITON® X-100, 41.6 mM $MgCl_2$, 1 mM $ZnC_2H_3O_2$, 10% (v/v) glycerol, 0.3% (v/v) ethanol, 0.02% (w/v) methyl paraben, and 0.01% (w/v) propyl paraben. Other solutions which can be formulated for use in an amplification procedure will be readily appreciated by those skilled in the art.

These and other features, aspects, and advantages of the present invention will become apparent to those skilled in the art after considering the following detailed description, appended claims and accompanying drawings.

DETAILED DESCRIPTION OF THE INVENTION

While the present invention may be embodied in a variety of forms, the following description and accompanying drawings are merely intended to disclose some of these forms as specific examples of the present invention. Accordingly, the present invention is not intended to be limited to the forms or embodiments so described and illustrated. Instead, the full scope of the present invention is set forth in the appended claims.

The figures illustrate a preferred closure system 10 of the present invention which includes a generally cylindrical container 20 and a corresponding cap 40 which has been adapted to grip an outer surface at an open end of the container. Closure systems according to the present invention have a novel sealing system which makes them useful for storing materials that remain at least partially fluid at sub-zero temperatures (e.g., fluid substances containing detergents, oils or surfactants) without a significant risk of leaking. As used herein, the term "zero" refers to 0° C. The containers and caps of these closure systems can be injection molded from plastic using procedures well known to those skilled in the art. In a preferred embodiment, the containers are molded from a polypropylene sold under the tradename Fina PP, grade 3622 (ATOFINA Petrochemicals; Houston, Tex.) or a clarified random copolymer having high molded clarity sold under the tradename Rexene, product number 13T10ACS279 (Huntsman Corporation; Houston, Tex.), and the caps are molded from a high density polyethylene sold under the tradename Alathon, product number M5370 (Equistar Chemicals, LP; Houston, Tex.). The materials of the container 20 and cap 40 are selected to contain no leachables or extractable materials under the intended conditions of use (e.g., storing reagents for use in an amplification reaction for nucleic acid testing).

Figure 1:
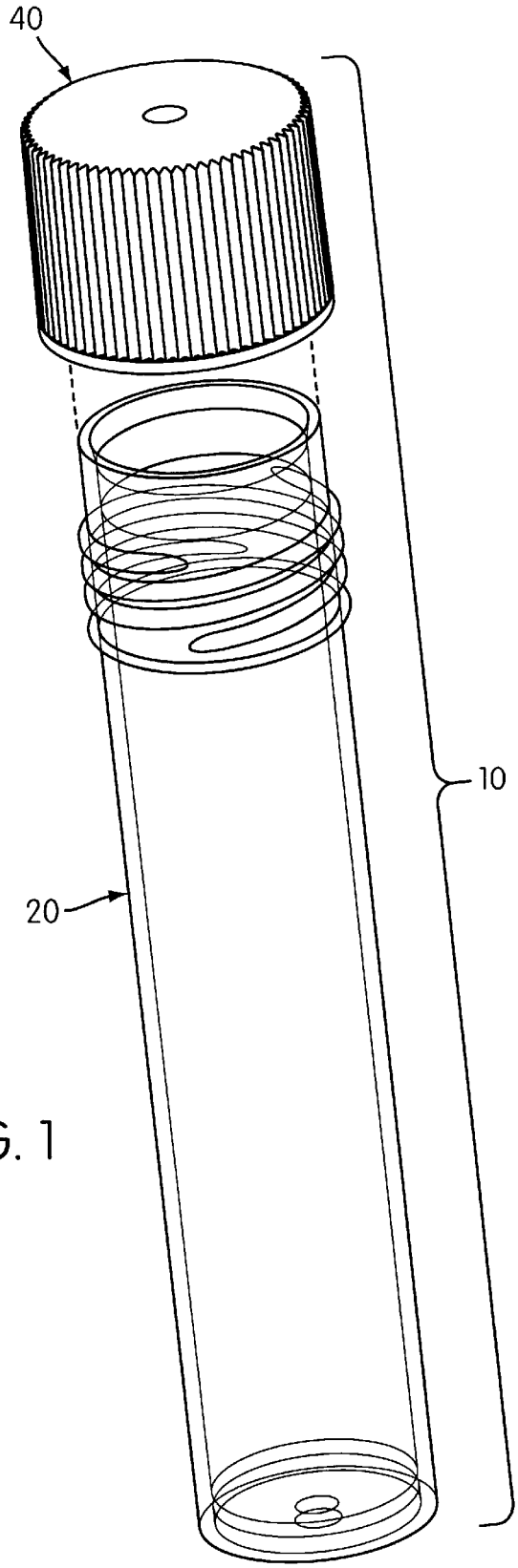
FIG. 1 is an exploded perspective view of a closure system (i.e., cap and container) according to the present invention.
Figure 7:
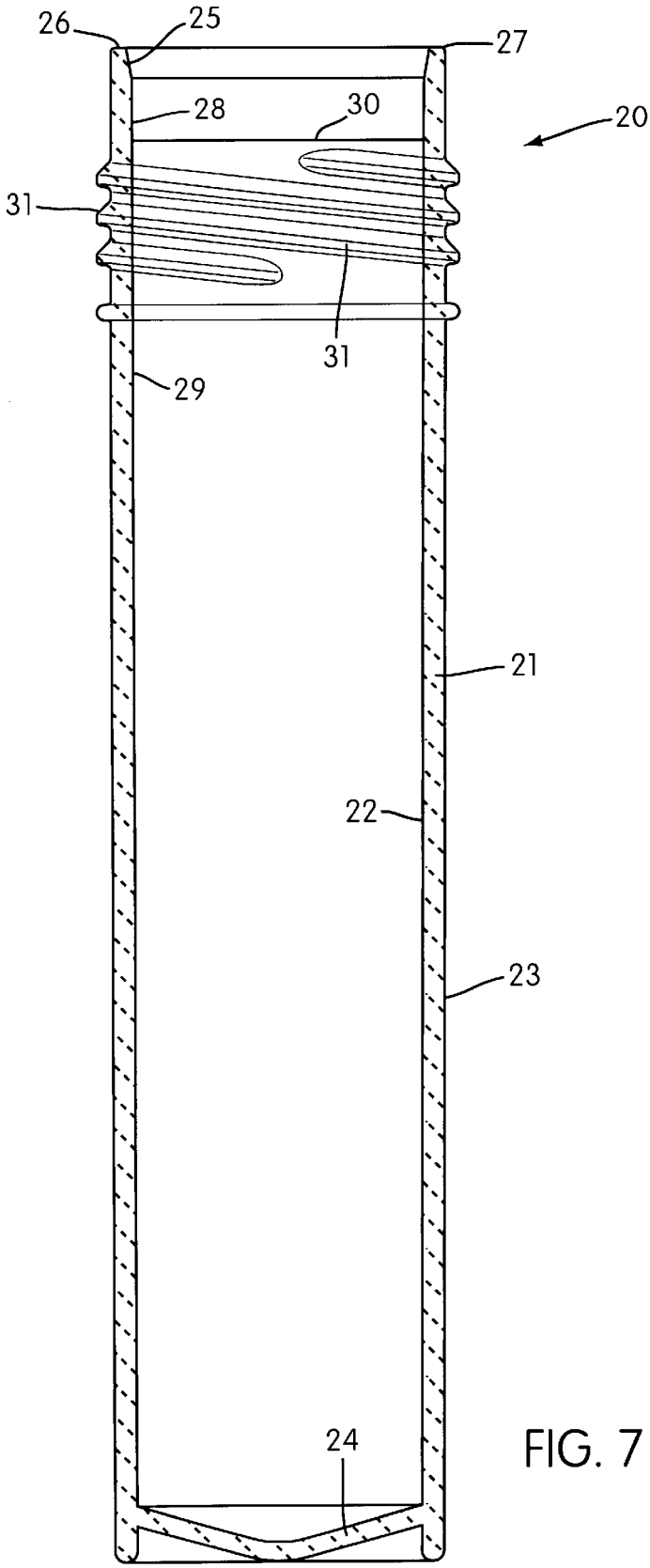
FIG. 7 is an enlarged section side view of the container of FIG. 6, taken along the 7—7 line thereof.

FIGS. 1 and 7 illustrate a preferred container 20 of the present invention. This container 20 includes a cylindrical side wall 21 having inner and outer surfaces 22, 23 and a bottom wall 24 for containing fluid substances. The distal end of the cylindrical side wall 21 preferably forms a skirt around the bottom wall 24 which allows for unaided, upright storage of the container 20. The total fill volume of this preferred container is approximately 62 ml, while the expected fluid capacity is approximately 50 to 55 ml (about 80% to about 85% of the total fill volume). As used herein, the phrase "total fill volume" refers to the fluid volume of the container when the container is filled to the brim. To minimize "dead volume" in the container 20 (i.e., fluid volume remaining in the container after manual or automated removal of fluid from the container) under conditions of use, the bottom wall 24 is preferably constructed to slope upward from a point coincident with the longitudinal axis of the container to the inner surface 22 of the side wall 21, thereby directing fluid toward the bottom, center of the container. However, the degree of this slope should be minimized to the extent possible in order to maximize "head space" in the container 20 (i.e., internal volume between the top of the fluid and a bottom surface 43 of the cap 40) as the fluid contents of the container begin expanding during the freezing process. The inventors found that a bottom wall 24 angle of about 10° to about 15°, and more preferably a bottom wall angle of about 12°, was optimal for minimizing dead volume and maximizing head space in the preferred closure system 10.

As shown in FIG. 7, the inner surface 22 of the preferred container 20 includes three distinct sections. The first section 25 of the inner surface 22 is a beveled lip which depends from the inner circumference of an annular top rim 26. (The perimeter 27 of the top rim 26 is rounded during injection molding to prevent vertical flash from forming which could interfere with proper sealing of the cap 40 on the container 20.) While the precise angle of this first section is not critical, an angle of about 10° relative to the longitudinal axis of the container 20 is preferred. The second section 28 is a "no draft section" (i.e., the inner surface 22 is substantially parallel to the longitudinal axis of the container 20) which adjoins the first section 25. In the preferred container 20, the thickness of the cylindrical side wall is approximately 0.051 inches (1.30 mm) at the top rim 26 and approximately 0.069 inches (1.75 mm) at the juncture separating the first and second sections 25, 28. Moreover, the preferred longitudinal distance from the top rim 26 to the juncture separating the second and third sections 28, 29 is approximately 0.300 inches (7.62 mm). The third section 29 includes an inward draft which extends from the bottom of the second section 28 to the intersection of the bottom wall 24 and the inner surface 22. This draft is included to facilitate removal of the container 20 from the mold after injection molding. (A line 30 appearing in FIG. 7 indicates the horizontal section of the container 20 separating the second and third sections 28, 29.) The core pin used to form the inner surface 22 of the container 20 is preferably provided a radial polish using methods well known to those skilled in the art of injection molding to prevent the formation of draw and sink lines on the inner surface of the container. Additionally, that portion of the core pin used to form the second section 28 is further hand-lapped using methods well known to those skilled in the art of injection molding to remove any polish lines which may have formed during the radial polish in this region of the core pin. As a result of polishing and hand-lapping the core pin, the inner surface 22 of the container 20 has an SPI B1 finish, except in the second section 28, which has an SPI A2 finish.

Figure 3:
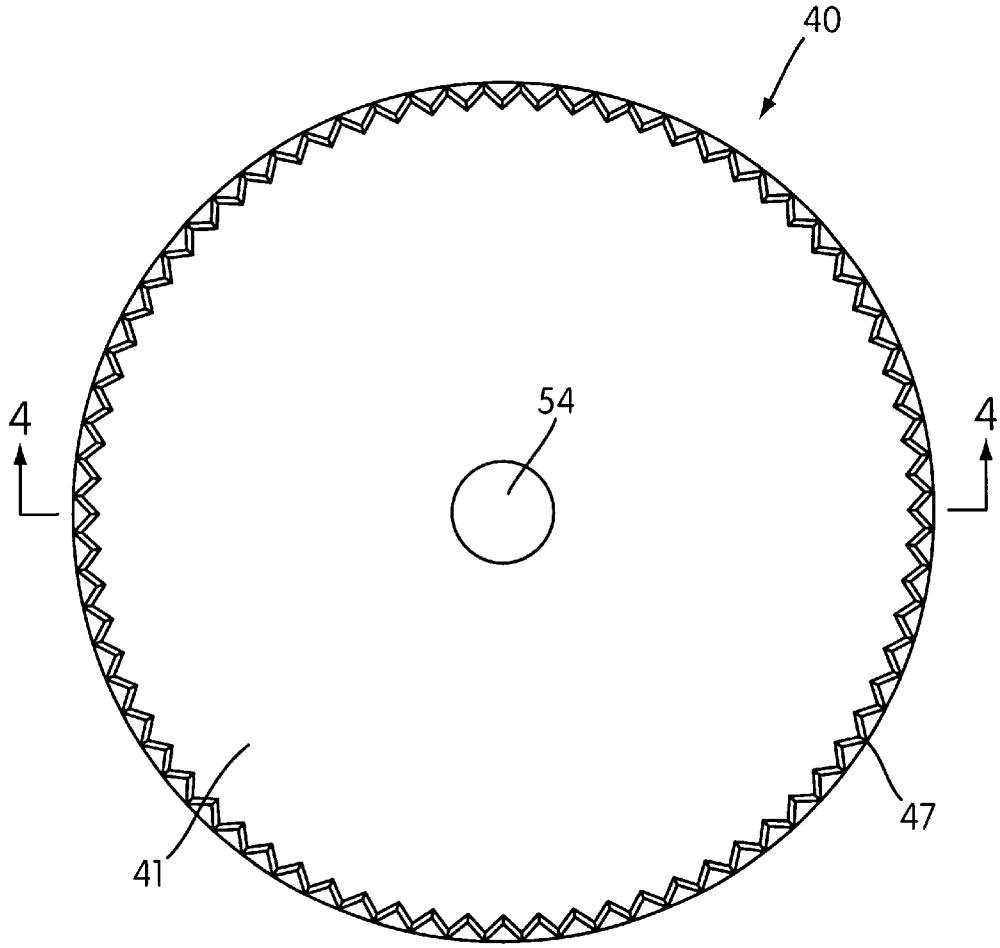
FIG. 3 is an enlarged top view of the cap of FIG. 1.
Figure 4:
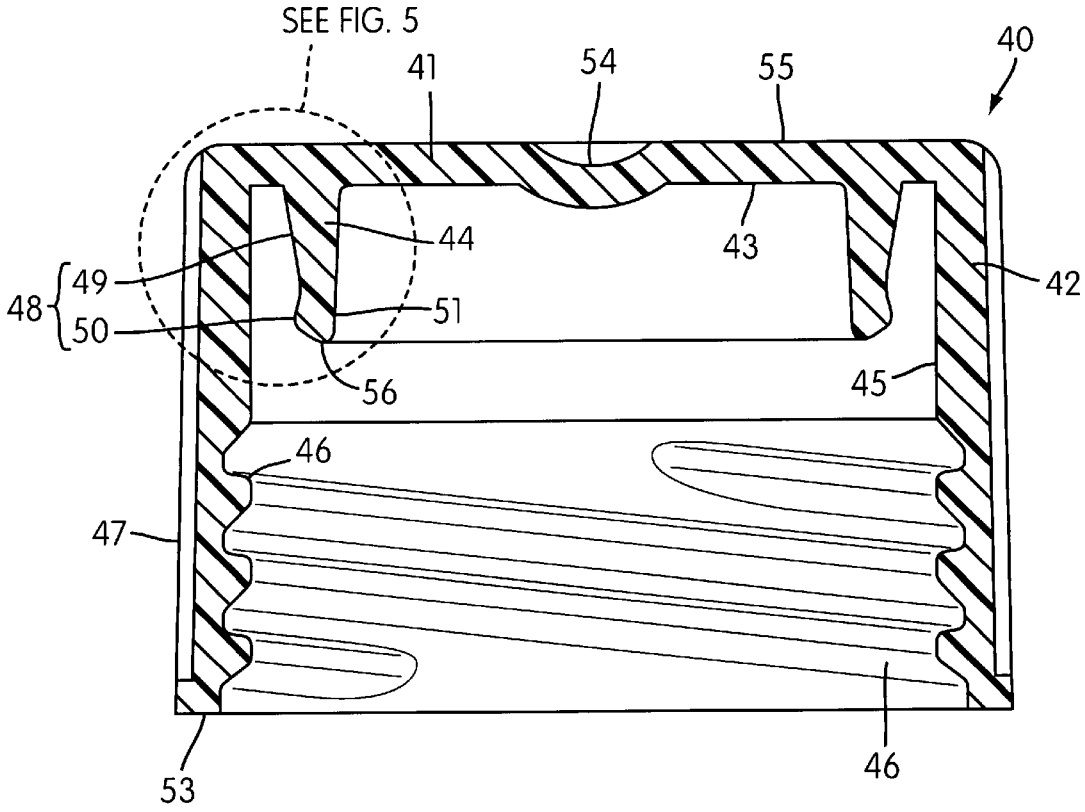
FIG. 4 is an enlarged section side view of the cap of FIG. 3, taken along the 4—4 line thereof.
Figure 8:
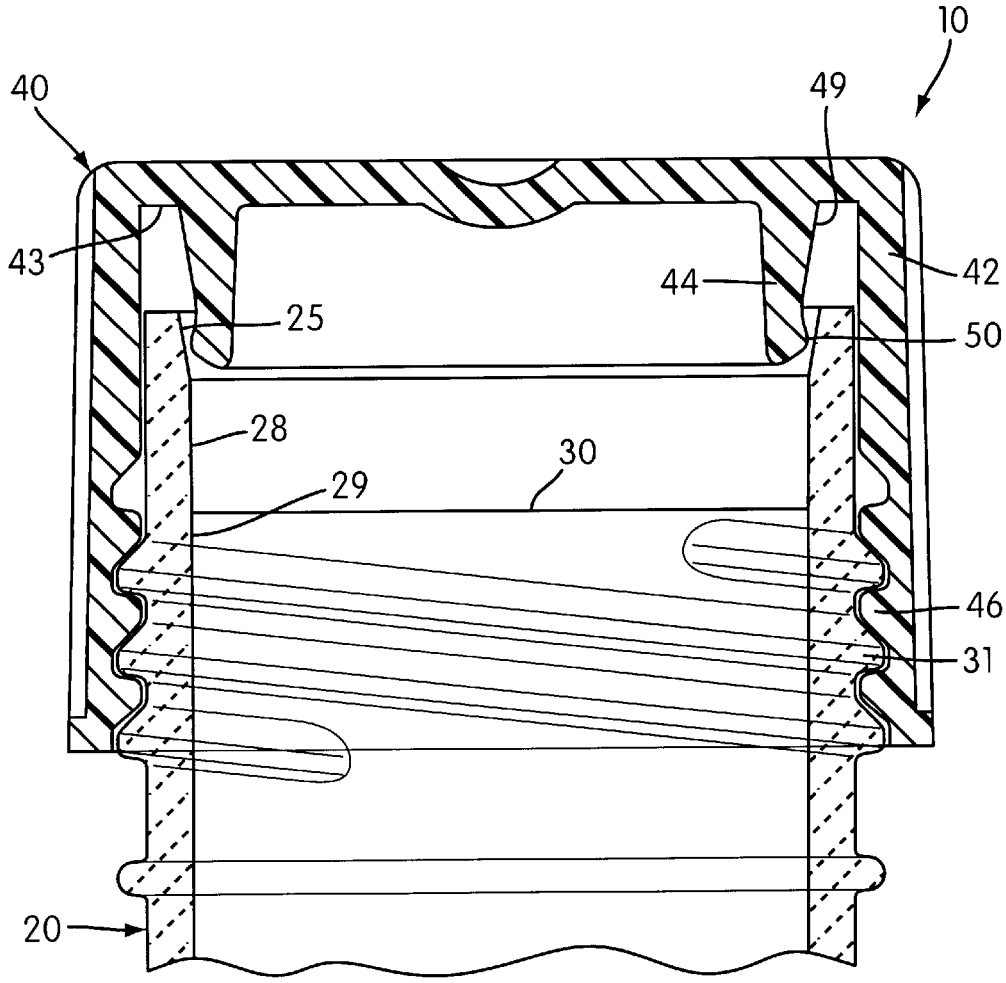
FIG. 8 is an enlarged partial section side view of the closure system of FIG. 1 (i.e., the cap of FIG. 4 in combination with the container of FIG. 7), where an annular inner skirt of the cap is inserted into the container but not so far that the annular inner skirt is in contact with a surface of the container.
Figure 9:
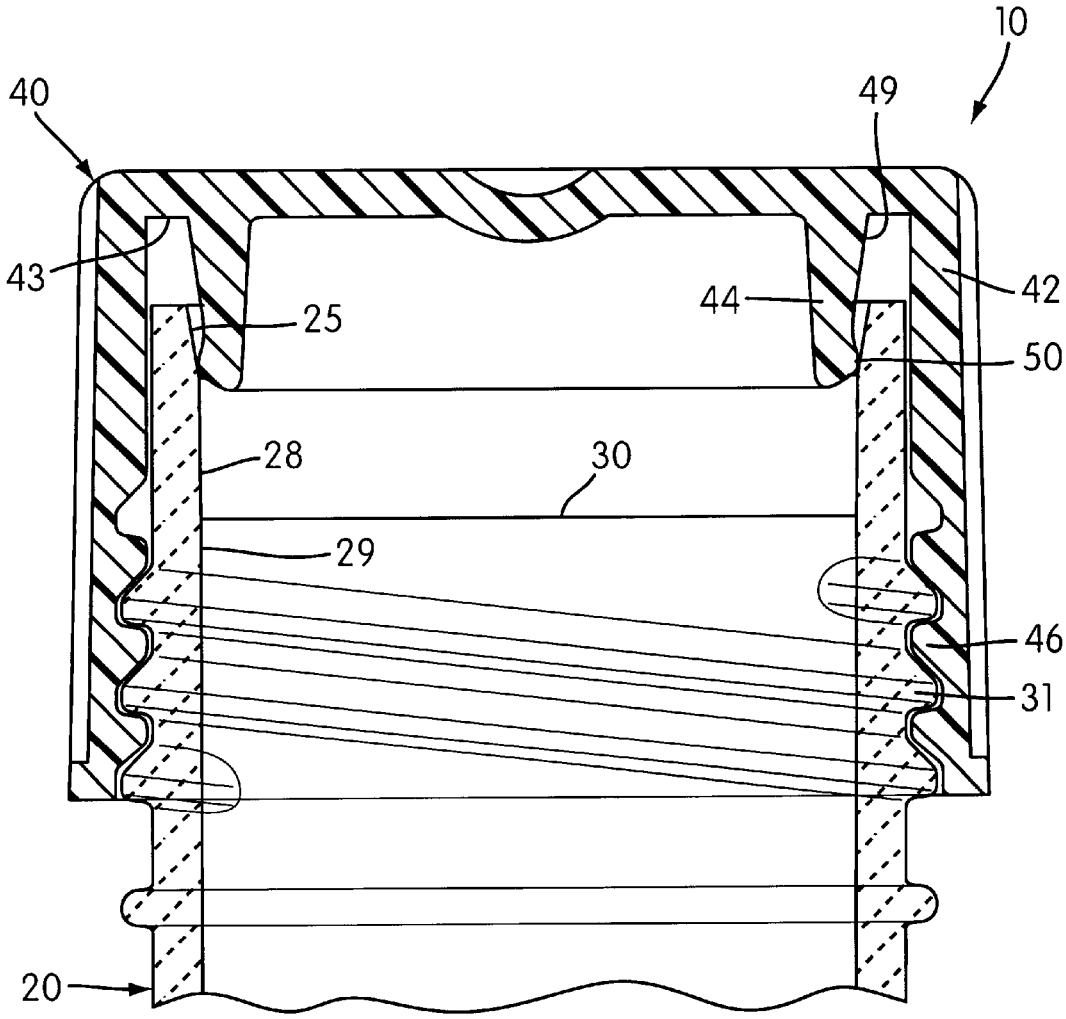
FIG. 9 is the closure system of FIG. 8, except that the annular inner skirt of the cap has been inserted far enough into the container that the annular inner skirt is in contact with a beveled lip of the container but not so far that the annular inner skirt has been deflected inward by an inner surface of the container.
Figure 10:
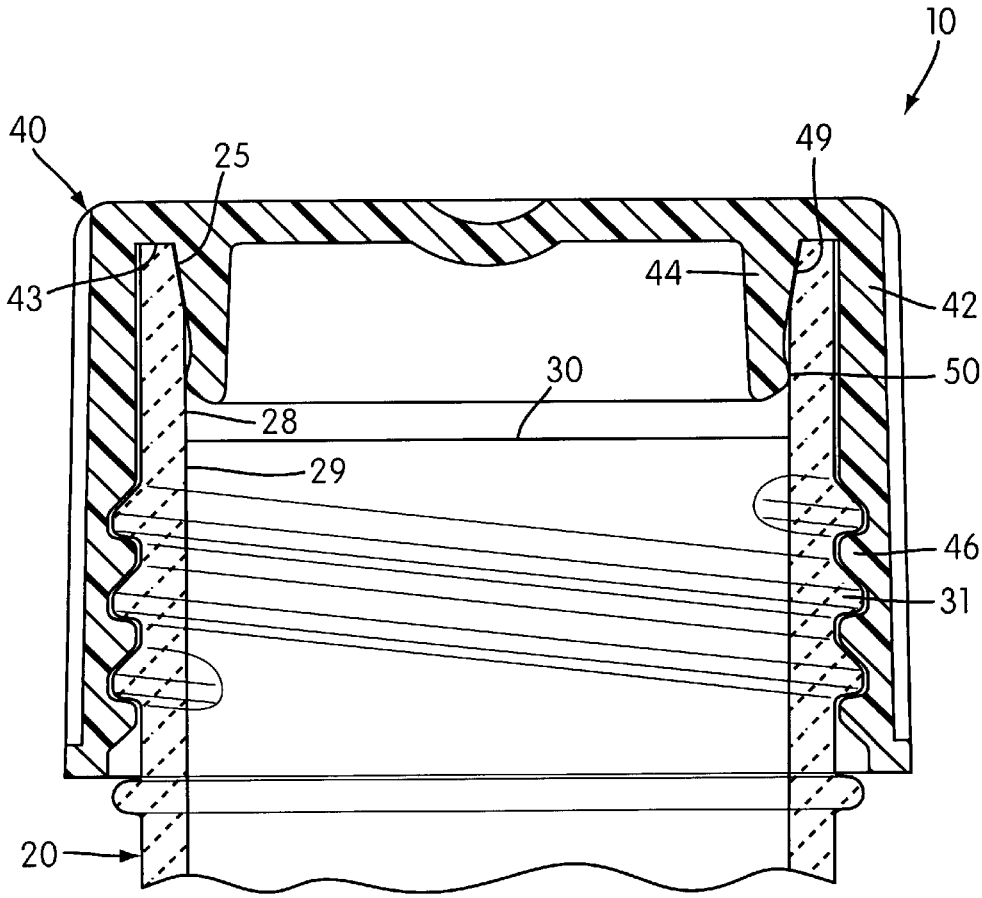
FIG. 10 is the closure system of FIG. 9, except that the annular inner skirt of the cap has been fully inserted into the container such that the annular inner skirt is in contact with a no draft region of the container and has been deflected inward by the inner surface of the container.

FIG. 4 illustrates the preferred cap 40 in cross-section. This cap 40 includes a circular top wall 41, an annular outer skirt 42 which depends from the periphery of the bottom surface 43 of the top wall, and an annular inner skirt 44 which is centered under, and depends from, the bottom surface of the top wall. An inner surface 45 of the outer skirt 42 is adapted to grip the outer surface 23 at the open end of the container 20. As shown in FIGS. 8–10, gripping is preferably achieved by use of mated, helical threads 31, 46 molded onto the outer surface 23 of the container 20 and the inner surface 45 of the outer skirt 42. Buttress threads (see FIGS. 8–10) are particularly preferred, since the configuration of buttress threads (having, in the preferred embodiment, an angle of about 45° on one side and an angle of about 10° on the other side) allows for greater torque and, therefore, provides for a more secure attachment of the cap 40 to the container 20. Other attachment means are also contemplated by the present invention, including, but not limited to, mated rims (not shown) molded onto the outer surface 23 of the container 20 and the inner surface 45 of the outer skirt 42 which are sized and arranged to permit the cap to be fitted onto the container by means of a snap-fit. The outer surface 47 of the cap 40 is preferably adapted for manual manipulation, such as by the inclusion of a series of serrations (see FIG. 3 in particular).

The inner skirt 44 includes an outer surface 48 comprising an upper beveled portion 49 and a lower seal bead 50. As depicted in FIG. 10, the surface of the upper beveled portion 49 mates with the first section 25 (i.e., the beveled lip) of the inner surface 22 of the container 20 when the cap 40 is fitted onto the container, thereby forming a snug, interference fit between the two surfaces which acts as a secondary fluid seal. (As used herein, the term "fitted" means that the cap 40 is fully attached to the container 20, e.g., the lower surface 43 of the top wall 41, as shown in FIG. 10, is in touching contact with the top rim 26 of the container 20, which functions as a stop as the cap is screwed onto or otherwise attached to the container.) To properly mate with the beveled lip 25, the beveled portion 49 in the preferred embodiment has a matching angle of about 10° degrees relative to the longitudinal axis of the container 20. The seal bead 50 has an outer diameter which is preferably smaller than the inner diameter of the top rim 26 of the container 20 and greater than the inner diameter of the second section 28 of the container. In a preferred embodiment, the outer diameter of the seal bead 50 will be from about 0.006 inches (0.152 mm) to about 0.010 inches (0.254 mm) greater than the inner diameter of the second section 28 of the container 20. Thus, as the outer skirt 42 of the cap 40 is attached to the container 20 and the inner skirt 44 of the cap is inserted into the interior of the container, the seal bead 50 is deflected inward, as illustrated in FIGS. 8–10, thereby increasing the load of the seal bead against the inner surface 22 of the container. (The inventors prefer a space of about 0.010 inches (0.254 mm) to about 0.019 inches (0.483 mm) between the inner surface 45 of the outer skirt 42 and the outer surface 23 of the container 20 when the cap 40 is fitted onto the container.) When the cap 40 is fitted onto the container 20, the seal bead 50 is forced against the second section 28 of the container 20, and the force of the seal bead against the second section creates an interference force fit which forms the primary fluid seal.

Figure 5:
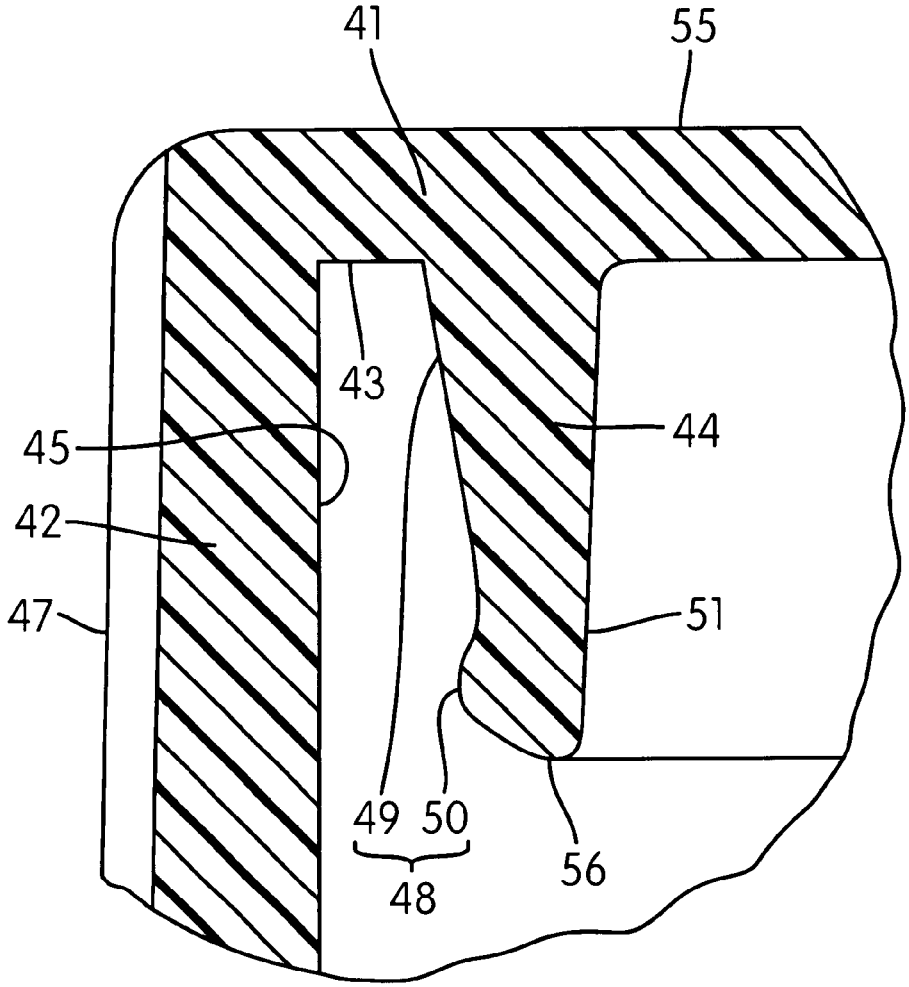
FIG. 5 is an enlarged partial section side view of the cap of FIG. 4.
Figure 6:
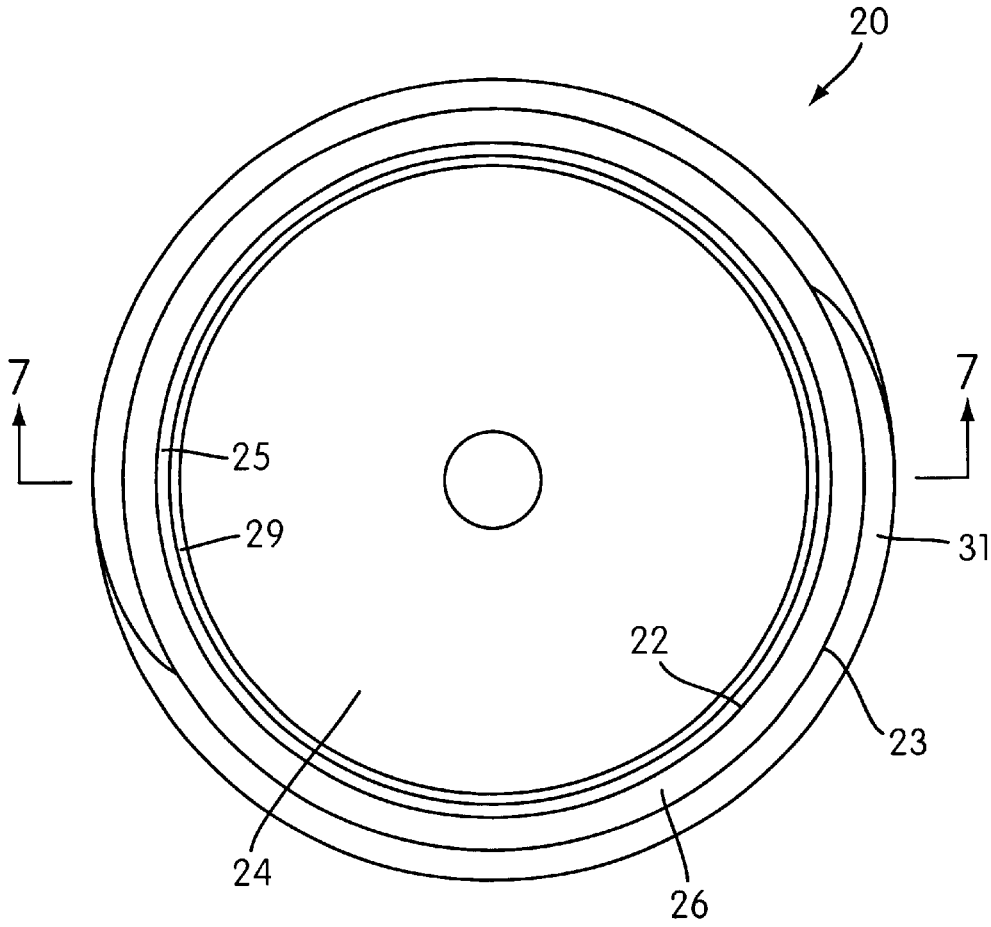
FIG. 6 is an enlarged top view of the container of FIG. 1.

FIGS. 4 and 5 show a bottom surface 56 of the inner skirt 44 which is rounded, preferably having a radius of about 0.015 inches (0.381 mm), and which is believed to function as a diverter, forcing at least a portion of an expanding meniscus into an area defined by the inner surface 51 of the inner skirt under cold storage conditions. Without this diverter feature, it is thought that an expanding meniscus could be forced between the outer surface 48 of the inner skirt 44 and the inner surface 22 of the container 20, thereby weakening the sealing contact between the seal bead 50 and the inner surface of the container. Rather than being rounded, the bottom surface 56 of the inner skirt 44 could be, for example, beveled. However, the rounded configuration is preferred for attachment purposes.

By providing a radial polish and hand-lapping to that portion of the core pin which corresponds to the second section 28, as described above, draw and sink lines are largely avoided during molding and cooling. Preventing or minimizing the formation of draw and sink lines in the inner surface 22 of the second section 28 is important since draw and sink lines can act as channels permitting fluids to pass from the interior space of containers under the higher internal pressures imposed by freezing conditions. In addition, the no draft aspect of the second section 28 discussed supra provides for maximum deformation of the seal bead 50 against the inner surface 22 of the container 20 when the cap 40 is fitted onto the container (see FIG. 10), as the smallest surface area of the seal bead initially contacts the second section of the container, thereby providing a uniform circular seal.

In the preferred embodiment, the inner skirt 44 extends a longitudinal distance of approximately 0.246 inches (6.25 mm) from the bottom surface 43 of the top wall 41. The greatest thickness of the upper beveled portion 49 is approximately 0.176 inches (4.47 mm). The inner surface 51 of the annular inner skirt 44 tapers outward as it depends from the bottom surface 43 of the top wall 41, having an inner diameter of approximately 0.932 inches (23.67 mm) at the proximal end and an inner diameter of approximately 0.954 inches at the distal end (24.23 mm) above the bottom surface 56. Additionally, the region joining the bottom surface 43 of the top wall 41 and the inner surface 51 of the inner skirt 44 has an inner radius of about 0.020 inches (0.508 mm). The seal bead 50 has an outer radius of about 0.015 inches (0.381 mm) and a maximal diameter which lies approximately 0.212 inches (5.38 mm) below the bottom surface 43 of the top wall 41. A longitudinal distance of approximately 0.034 inches (0.86 mm) separates the outer diameter of the seal bead 50 from the distal end of the bottom surface 56 of the inner skirt 44. The outer diameter of the outer surface 48 of the inner skirt 44 is approximately 1.053 inches (26.75 mm), where the seal bead 50 and the upper beveled portion 49 meet, and the angle of the seal bead depending from this juncture is about 15° relative to the longitudinal axis of the cap 40. The greatest thickness of the seal bead is approximately 0.061 inches (1.55 mm). On the bottom surface 43 of the top wall 41, the inner diameter of the outer skirt 42 is approximately 1.22 inches (31.00 mm) and the outer diameter of the inner skirt 44 is approximately 1.108 inches (28.14 mm).

Figure 2:
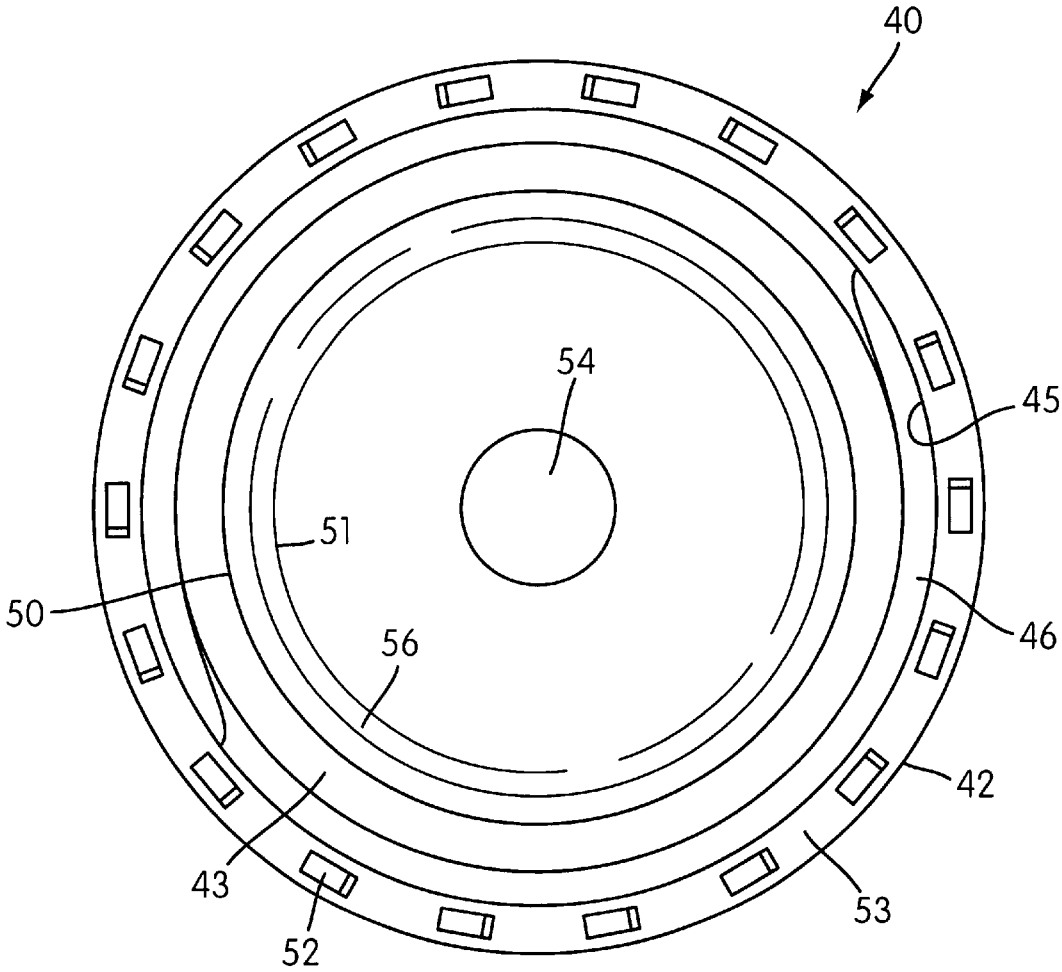
FIG. 2 is an enlarged bottom view of the cap of FIG. 1.

As illustrated in FIG. 4, the outer surface 48 of the inner skirt 44 has a generally arcuate shape between the upper beveled portion 49 and the seal bead 50, giving the annular inner skirt a bowed configuration. This bowed configuration allows for greater deflection of the seal bead 50 as the cap 40 is fitted onto the container 20, since the inner skirt 44 functions like a spring to increase the load of the seal bead against the second section 28 of the inner surface 22 of the container. Once the cap 40 is fitted onto the container 20, as shown in FIG. 10, the arcuate shape of the outer surface 48 of the inner skirt 44 results in the formation of an annular air pocket between the outer surface of the inner skirt and the inner surface 22 of the container 20 and between the upper beveled portion 49 and the seal bead 50. To protect this desired arcuate configuration of the inner skirt 44 during the molding process, the mold core is preferably rotated off the cap 40 using any appropriate anti-rotational device well known to those skilled in the art of injection molding rather than ejecting the cap off the mold core. Rectangular impressions 52 formed on a bottom surface 53 of the outer skirt 42, as shown in FIG. 2, facilitate this rotational removal of the mold core from the molded cap 40. Additionally, urethane springs well known to those skilled in the art of injection molding can be provided to the steel plates used to form the cap 40 which allow for sufficient mold opening between the steel plates to prevent damage to the seal bead 50.

FIGS. 1–4 and 8–10 show a dimple 54 recessed from a top surface 55 at the center of the top wall 41 of the cap 40, which indicates the location where plastic material was injected through a gate in the cap mold by an injection molding gating device. While conventional plastic container caps have a rough, protruding gate vestige at this location, the inventors of the present invention specifically designed the mold for the cap 40 so that the dimple 54 would be formed. The dimple 54 formation, because it is recessed from the top surface 55 of the top wall 41, reduces the chance that a technician handling the closure system 10 of the present invention will snag or tear a protective glove (e.g., surgical glove) on such a gate vestige. This feature of the cap 40 is particularly advantageous when the closure system 10 being handled contains toxic or potentially contaminating materials.

The holding capacity of closure systems according to the present invention may vary depending upon the needed amounts of reagent. Preferred is a holding capacity of about 50 ml. The maximum holding capacity of these closure systems is preferably at least about 70% of the total fill volume of the closure systems, more preferably at least about 75%, even more preferably at least about 80%, and most preferably at least about 85%.

Closure systems of the present invention are especially suited for storing fluid substances which contain one or more components affecting the viscosity or surface tension of the stored fluids or which contribute to freezing point depression of the stored fluids. In a particularly preferred embodiment, the closure systems of the present invention are useful for storing amplification and enzyme reagents at sub-zero temperatures, more particularly at temperatures between about −20° C. and about −40° C., and most preferably at a temperature of about −20° C. Amplification reagents which may be stored in the closure systems of the present invention include, inter alia, nucleoside triphosphates and/or amplification primers useful for primer-directed enzymatic amplification of a nucleic acid sequence of interest. The amplification primers are generally oligonucleotides comprising DNA or RNA but may include nucleic acid analogs recognized by a polymerase. See, e.g., Becker et al., "Method for Amplifying Target Nucleic Acids Using Modified Primers," U.S. Pat. No. 6,130,038. Examples of amplification primers include, but are not limited to, those described in the references set forth in the Background of the Invention section supra. For transcription-based amplifications, the amplification primers include primers having a 5' sequence recognized by an RNA polymerase which enhances initiation or elongation by an RNA polymerase. See, e.g., U.S. Pat. No. 5,399,491. In some cases, it may be desirable to include amplification primers which are labeled for detection. See, e.g., Nadeau et al., "Detection of Nucleic Acids by Fluorescence Quenching," U.S. Pat. No. 6,054,279.

Enzyme reagents which may be stored in the closure systems of the present invention include enzymes which can be used in the enzymatic synthesis of a nucleic acid sequence of interest. Such enzymes include RNA-dependent DNA polymerases, RNA-dependent RNA polymerases, DNA-dependent DNA polymerases and DNA-dependent RNA polymerases. Preferred for the present invention are polymerases useful for transcription-mediated amplification (TMA). See, e.g., U.S. Pat. No. 5,399,491. Examples of such polymerases include reverse transcriptase and RNA polymerase (e.g., bacteriophage T7 RNA polymerase). Enzymes for use in other amplification procedures are contemplated, and include heat-stabile DNA polymerase (e.g., Taq DNA polymerase) for use in the polymerase chain reaction (PCR), DNA ligase for use in the ligase chain reaction (LCR), Qβ replicase for use in the Qβ replicase system, and a DNA polymerase and a specific restriction endonuclease for use in strand displacement amplification (SDA). See HELEN H. LEE ET AL., NUCLEIC ACID AMPLIFICATION TECHNOLOGIES: APPLICATION TO DISEASE DIAGNOSIS (1997).

While the present invention has been described and shown in considerable detail with reference to certain preferred embodiments, those skilled in the art will readily appreciate other embodiments of the present invention. Accordingly, the present invention is deemed to include all modifications and variations encompassed within the spirit and scope of the following appended claims.

What we claim is:

1. A closure system for use in storing fluids under cold storage conditions, the closure system comprising:

a generally cylindrical container including a side wall having inner and outer surfaces, a closed bottom end and an open top end having an annular top rim and a beveled lip depending inwardly from the inner circumference of the annular top rim; and a cap including a generally circular top wall, an outer skirt depending from the periphery of the top wall and having an inner surface adapted to grip the outer surface of the top end of the container, and an inner skirt depending from the top wall and having an outer surface comprising a lower seal bead and an upper beveled portion mated with the beveled lip, such that when the cap is fitted onto the container, the seal bead is dimensioned to be in sealing contact with the inner surface of the top end of the container and the upper beveled portion and the beveled lip are dimensioned to be engaged in an interference fit.

2. The closure system of claim 1, wherein the inner surface of the container adjacent to and below the beveled lip includes a no draft region substantially parallel to the longitudinal axis of the container, wherein the seal bead is in sealing contact with the no draft region when the cap is fitted onto the container.

3. The closure system of claim 2, wherein the outer diameter of the seal bead is smaller than the inner diameter of the top rim and greater than the inner diameter of the no draft region.

4. The closure system of claim 2, wherein the no draft region is formed with a core pin treated to prevent the formation of draw and sink lines on the inner surface of the no draft region when the container is injection molded and cooled.

5. The closure system of claim 4, wherein the core pin is radial polished and hand-lapped prior to injection molding the container.

6. The closure system of claim 1, wherein an air pocket is formed between the outer surface of the inner skirt and the inner surface of the container and between the seal bead and the upper beveled portion when the cap is fitted onto the container.

7. The closure system of claim 1, wherein the inner skirt has a bottom surface configured to function as a fluid diverter under cold storage conditions.

8. The closure system of claim 1, wherein the bottom surface of the top wall contacts the top rim when the cap is fitted onto the container.

9. The closure system of claim 1, wherein the inner surface of the outer skirt and the outer surface of the open end of the container include mated helical threads.

10. The closure system of claim 1, wherein the container is formed from polypropylene and the cap is formed from a high density polyethylene.

11. The closure system of claim 1, wherein the closure system contains a solution having added thereto at least one component which contributes to freezing point depression of the solution, increases the viscosity of the solution, or alters the surface tension of the solution.

12. The closure system of claim 11, wherein the added component is selected from the group consisting of a salt, ethylene glycol, glycerol, dextran, a detergent, a surfactant and an oil.

13. The closure system of claim 11, wherein the solution includes one or more reagents useful for performing a nucleic acid amplification reaction.

14. The closure system of claim 13, wherein the reagents include one or more enzymes for performing a nucleic acid amplification reaction.

15. The closure system of claim 14, wherein the reagents further include amplification primers for performing a nucleic acid amplification reaction.

16. The closure system of claim 13, wherein the amplification reaction is a polymerase chain reaction amplification reaction.

17. The closure system of claim 13, wherein the amplification reaction is a transcription-based amplification reaction.

* * * * *